US006354784B1

(12) United States Patent
Farr

(10) Patent No.: US 6,354,784 B1
(45) Date of Patent: Mar. 12, 2002

(54) MECHANICALLY HANDLING FLOWABLE MATERIAL

(76) Inventor: Kenneth Farr, 3 Victoria Lane, Golcar, Huddersfield, West Yorkshire HD7 4JC (GB)

( * ) Notice: Subject to any disclaimer, the term of this patent is extended or adjusted under 35 U.S.C. 154(b) by 0 days.

(21) Appl. No.: 09/529,200

(22) PCT Filed: Oct. 8, 1998

(86) PCT No.: PCT/GB98/03028

§ 371 Date: Jun. 2, 2000

§ 102(e) Date: Jun. 2, 2000

(87) PCT Pub. No.: WO99/19219

PCT Pub. Date: Apr. 22, 1999

(30) Foreign Application Priority Data

Oct. 9, 1997 (GB) ..... 9721318

(51) Int. Cl.[7] ..... B65D 19/00; B65D 90/66

(52) U.S. Cl. ..... 414/414; 414/424; 222/185.1; 206/386

(58) Field of Search ..... 414/414, 424, 414/404; 108/51.11; 222/185.1; 294/68.21; 206/386

(56) References Cited

U.S. PATENT DOCUMENTS

| | | | | |
|---|---|---|---|---|
| 2,440,056 A | * | 4/1948 | McIntyre et al. | 222/185.1 |
| 2,690,277 A | * | 9/1954 | Shea et al. | 294/68.21 X |
| 3,921,892 A | | 11/1975 | Macie | |
| 4,247,021 A | * | 1/1981 | Renier et al. | 222/143 |
| 4,423,831 A | * | 1/1984 | Sipley | 222/185.1 |
| 5,687,881 A | | 11/1997 | Rouse et al. | |

FOREIGN PATENT DOCUMENTS

| | | | |
|---|---|---|---|
| DE | 2220124 A | | 11/1972 |
| EP | 204686 | * | 5/1986 |
| EP | 655047 | * | 7/1998 |
| FR | 2388734 A | | 11/1978 |
| FR | 2427261 A | | 12/1979 |
| FR | 2656592 A | | 7/1991 |
| GB | 0969124 | | 9/1964 |
| GB | 1588836 | | 4/1981 |
| NL | 7111407 A | | 2/1973 |
| WO | WO8203057 | | 9/1982 |
| WO | WO9304953 | | 3/1993 |

* cited by examiner

*Primary Examiner*—Steven A. Bratlie
(74) *Attorney, Agent, or Firm*—Trexler, Bushnell, Giangiorgi, Blackstone & Marr, LTD

(57) ABSTRACT

A rigid pallet base has a rigid frame provided with rigid supports within which frame there are pivoted rigid flaps also provided with rigid supports. The flaps are held closed during loading by contact between the ground and the supports on the flaps. The flaps are maintained closed during transport to a required location by an upward force exerted by conventional lift forks inserted between the inner and outer supports. By resting the supports on the frame upon suitably spaced-apart members at the required location and then removing the lift forks, the flaps are allowed to open without manual intervention for gravity discharge of the material. After discharge, replacing the lift forks and lifting the pallet base closes the flaps to return the base to its load-carrying condition also without manual intervention. Two flaps can be employed, or two co-operating pairs of flaps can be arranged to form a funnel-shaped discharge chute.

20 Claims, 11 Drawing Sheets

MECHANICALLY HANDLING FLOWABLE MATERIAL

BACKGROUND

This invention relates to mechanically handling flowable, especially discrete, material, and more particularly to the support and containment of such material upon a platform base which enables handling to be effected by means such as lift truck forks or pallet trucks throughout its filling or loading, transportation, storage and emptying operations.

It is well known to provide solid deck-spaced pallets upon which loads may be built and the formed unit mechanically handled up to the time when the carried load is required for its intended use and is removed, leaving the pallet in its single-purpose original, unchangeable state.

Throughout this specification, the expression "deck-spaced pallet base" is intended to define a pallet base which is held clear of the ground or other surface by rigid supports which allow the entry of lifting means.

It is also known to provide such pallet bases upon which superstructures such as boxes, cages, bags etc. may be mounted or placed to form pallet packs for containing materials or articles, and for such inter-bulk units to be mechanically handled up to the time when the carried contents mass is required.

Depending upon the particular application and systems in use, the emptying of such inter-bulk pallet packs can be carried out manually, mechanically, pneumatically, or by package inversion, but in every case, whether fixed to or releaseably secured to the containment structure, the pallet base retains its permanent deck-spaced solid form.

This feature is still evident in the load containment systems disclosed by U.K. Design Registration-No. 1022405, International Patent Publication WO/03057, European Patent Specification No. 0073787, and U.K. Patent Specifications Nos. 248162 and 2147269, and also a precursor to the present invention, U.S. patent application Ser. No. 9,616,436.3; all of which relate to my inventions concerning the use of base handling sleeves which are expansible and collapsible. While such sleeves can enable loads carried upon them to be handled by fork-lift trucks, they preclude the use of pallet trucks and the four-way entry capabilities of deck-spaced pallet bases.

SUMMARY

The object of the present invention is to provide means for more effectively discharging flowable material from a pallet pack or a pallet base.

According to one aspect of the invention, a method of mechanically handling flowable material comprises loading it onto a deck-spaced pallet base having a frame provided with rigid supports within which frame there are pivotally mounted downwardly-openable means also provided with rigid supports whereby the means are held closed during loading by contact between the ground and the supports on said means, transporting the loaded base to a required location by applying a lifting force beneath the means which acts to hold them closed during transport, resting the supports on the frame upon suitably spaced-apart members at said location, and removing said force to permit the means to open without manual intervention for gravity discharge of the material.

Preferably, the method further comprises applying the force by means of the forks of a fork-lift truck.

The method may further comprise containing the material in a bag having a discharge sock, and keeping the sock closed by employing said means to pinch it until they are permitted to open.

The method may further comprise containing the material in a flexible liner within a box mounted on the pallet base, the liner having a discharge sock closed by employing said means to pinch it until they are permitted to open, and an inlet sock closed by pinching it in a lid for said box.

The method may further comprise loading or unloading a box mounted on the pallet base by resting the frame on suitably spaced-apart members so that the means are permitted to open, inserting a ram upwardly through the opening, and activating the ram in stages so as to lower into or raise out of the box successive layers of items such as bottles supported on rigid sheets which fit closely within the box.

According to another aspect of the invention, apparatus for mechanically handling flowable material comprising a deck-shaped pallet base having a frame provided with rigid supports within which frame there are pivotally mounted downwardly-openable means also provided with rigid supports.

The downwardly-openable means preferably comprise a pair of flaps pivotally mounted on elements at opposed sides of the frame, outer supports fixed to said elements, and inner supports fixed to the ends of the flaps remote from their pivots.

Preferably, the inner and outer supports are so spaced apart so as to allow entry of the forks of a fork-lift truck from any side of the pallet base.

Preferably, also, the adjacent faces of the outer supports are inclined in order to limit the angle of opening of the flaps.

Preferably, another pair of downwardly-openable flaps are pivotally mounted above the first mentioned pair thereof on the other two sides of the frame, said other pair of flaps being so shaped that their angle of opening is limited by the open position of the first-mentioned pair of flaps.

Preferably, also, the frame comprises the edges of a lower sheet incorporating the first-mentioned pair of flaps and the edges of a top sheet incorporating said other pair of flaps, the edges of the two sheets being fixed together.

Alternatively, the frame comprises the edges of a top sheet incorporating said other pair of flaps, the elements on which the first-mentioned pair of flaps are pivotally mounted being separately secured beneath opposing edges of the top sheet.

The pallet base may support a rigid box having, two pairs downwardly-openable flaps in its base.

The frame may comprise, or have fixed to it, upstanding sides which form a tray.

The corners of the tray may support vertical posts which are capable of being extended, of locating a liner and/or side panels, of being folded parallel to the pallet base, and/or of having a lid or top stays.

Alternatively, a foldable sleeve with open top and bottom fits within the sides of the tray both when erected and when collapsed.

A cap preferably fits over the sleeve when the sleeve is both erected and collapsed.

The pallet base may support a pallet collar or a vertical stack of a plurality of pallet collars.

The pallet base may support a box which is sub-divided in order to carry delicate items in bulk without damage by means of a central dividing wall slideable in vertical guides on the box, and at least one pair of horizontal dividing flaps pivotally mounted at their outer ends on bearers on the central wall, the arrangement being such that when the downwardly-openable means of the pallet base are permitted to open the central wall falls and permits the dividing flaps to pivot downwards for gravity discharge of the items.

The tray may support a box which is octagonal in plan view for-improved strength, a square or rectangular lid of the same shape and dimensions in plan view as the tray is provided for the box, and four fillets of triangular cross-section fit between the corners of the tray and the corners of the lid along the angled sides of the box to strengthen the box further.

The tray may support a collapsible sleeve which has internal flaps foldable to form hollow integral corner stiffeners.

BRIEF DESCRIPTION OF THE DRAWINGS

The invention will now be described, by way of example, with reference to the accompanying drawings, of which.

DESCRIPTION

Figure 1:
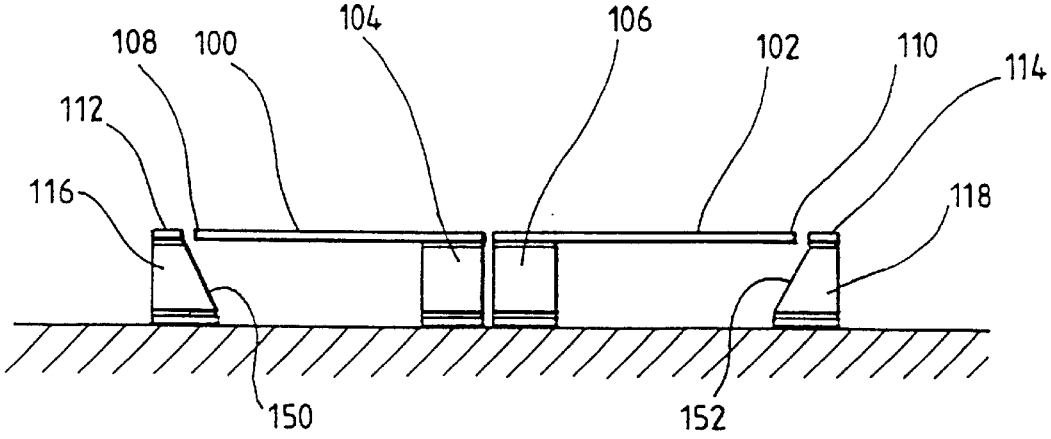
FIGS. 1 and 2 illustrate the basic concept of a pallet base with a pair of downwardly-openable flaps.
Figure 3A:
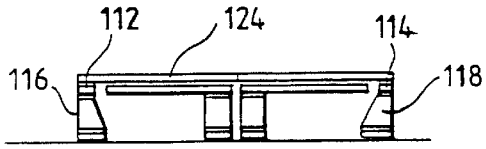
FIGS. 3A to 3D illustrate a preferred concept of a pallet base with two complementary pairs of downwardly-openable flaps.
Figure 3B:
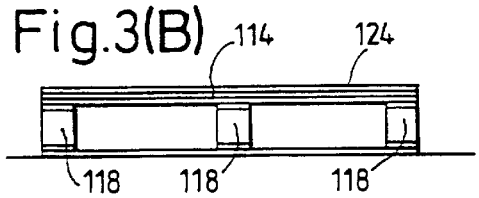
Figure 3C:
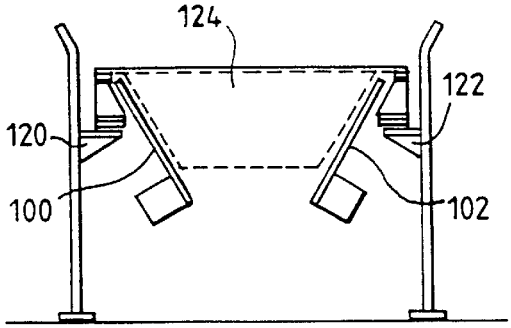
Figure 3D:
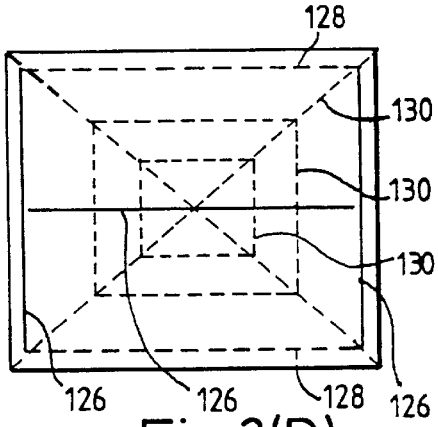
Figure 4A:
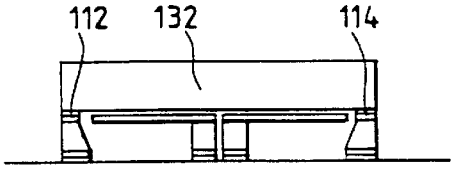
FIGS. 4A to 4D illustrate the basic concept with sides forming a tray.
Figure 4B:
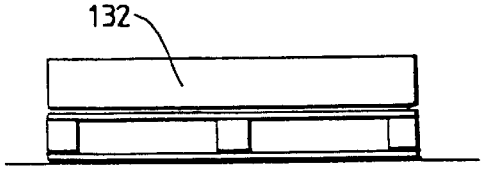
Figure 4C:
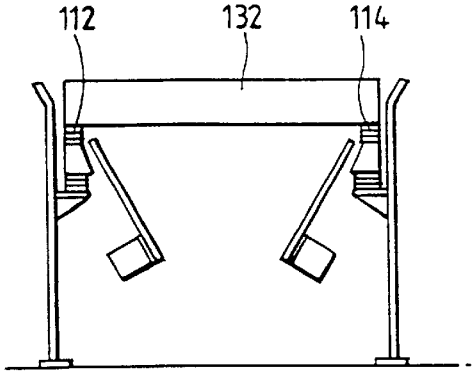
Figure 4D:
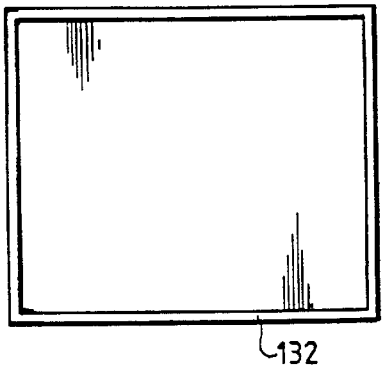
Figure 3E:
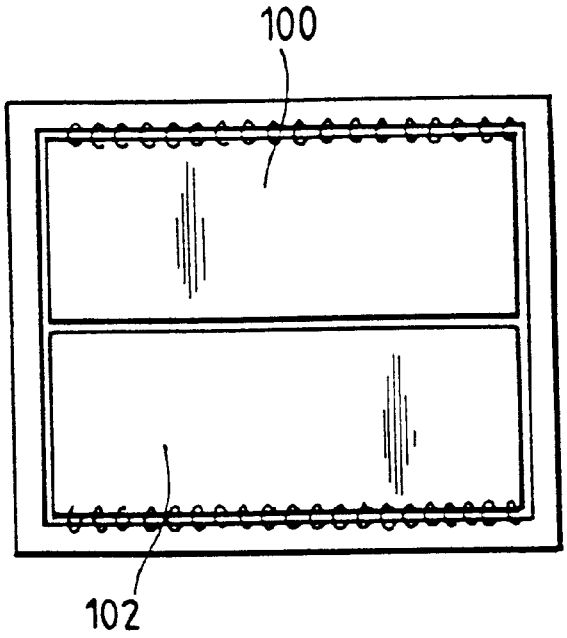
FIGS. 3E and 3F illustrate a refinement of FIGS. 3A to 3D.

Referring now to the drawings, FIG. 1 is an end view of a pallet base formed by a set of components including a pair of planar surfaces or flaps 100 and 102 which carry inner deck space supports 104 and 106 and are pivotally mounted by hinge facilities (not shown) at their edges 108 and 110 on elements or land surfaces 112 and 114 carrying outer deck space supports 116 and 118, so that said planar surfaces constitute downwardly-openable means, said land surfaces form opposed sides of a frame surrounding the planar surfaces 100 and 102, and lie at the same height as said planar surfaces when the assembly is at rest in a horizontal plane. The inner and outer supports are so placed apart (see for example FIG. 3B) so as to allow four-way entry of the forks of a fork-lift truck from any side of the pallet base.

Figure 2:
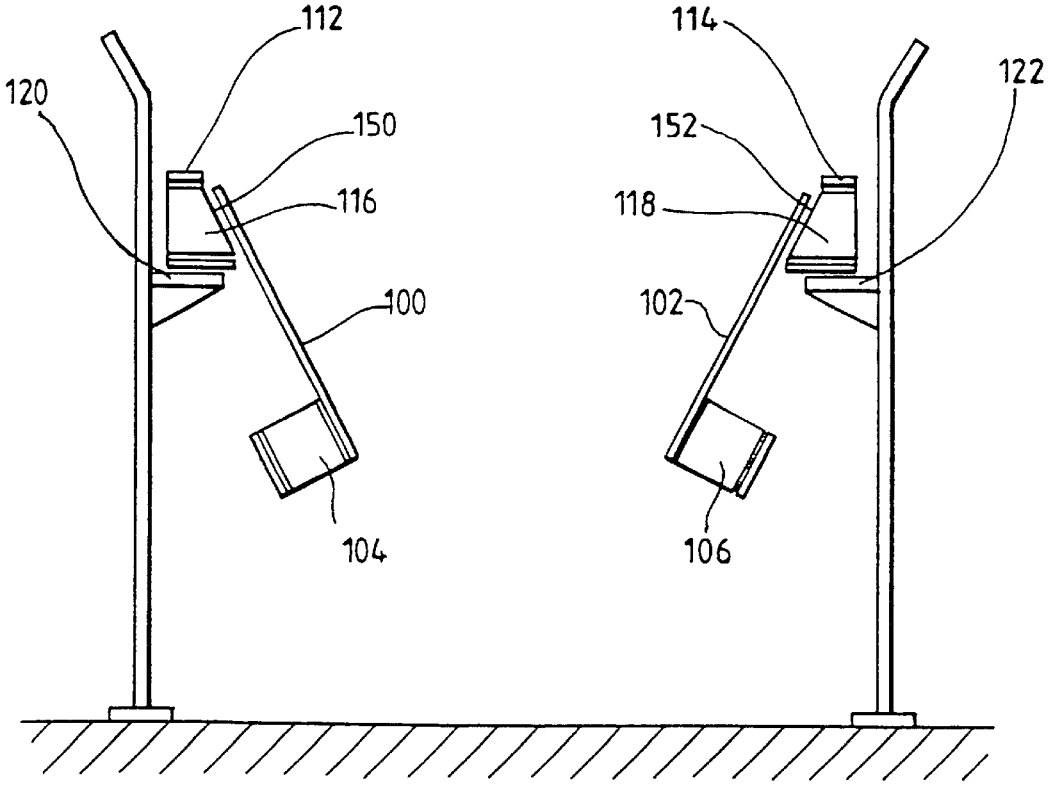

FIG. 2 is an end view of the pallet base of FIG. 1 which has been raised, by means for example of the forks of a forklift truck pressing into the deck spaces and bearing on the undersides of the planar surfaces 100 and 102, put to rest to bear only on supports 116 and 118 upon spaced-apart members or sections 120 and 122 of a discharge rig arrangement.

As the support for the pallet base afforded by the lift truck forks has been withdrawn, the surfaces 100 and 102, together with heir attached supports 104 and 106 have swung down about their hinge facilities to create a gap between the inner edges of 100 and 102. It is the creating of this gap which is the means whereby the invention can be made to fulfil the gravity discharge of its load. The land surfaces 112 and 114 remain horizontal.

The integrity of the assembly can be assured in a variety of ways, so that after the unit has effected its discharge function it can be made to swing back to the orientation depicted in FIG. 1 with the capability to resume its normal deck space pallet handling functions.

The means whereby the pallet base is caused to open downwardly for egressing loads, then re-articulating back to its original orientation to perform as a conventional pallet, can be other than the static discharge rig arrangement shown in FIG. 2.

For example, an arrangement of in-line roller conveyors can be constructed whereby the invention can be made to drop open, discharge its carried load, and then resume its pallet state, all whilst in a continuous or perhaps staggered mobile operation. Other mechanical means such as carousels, etc. may also be used, depending upon the application.

Similarly, depending upon particular needs, the materials from which the pallet base is constructed, the means of articulation, the geometry and type of deck space supports, etc. can be any to ensure that the invention can best perform its intended functions.

FIG. 3 shows how integrity of the pallet base can be achieved by means of a top sheet 124 affixed to the land surfaces 112 and 114 as in 3A and 3B, so that the edges of said sheet form the frame. FIG. 3D is a plan view of 3B showing only the top sheet 124, which is diecut at lines 126, creased at lines 128, whilst lines. 130 show how a variety of flap profiles may be selected which can be cut as requires to suit the particular discharge needs of different applications. FIG. 3C shows how the device thus assembled would behave when put to base discharging duty. It will be seen that sheet 124 has remained affixed to the land surfaces 112 and 114, and by virtue of its creases 128 and diecuts 126, its profiled flaps have complemented the now angled planar surfaces 100 and 102 to assist in the formation of a funnel-shaped discharge chute. That is to say, said profiled flaps are so shaped that their angle of opening is limited by the open position of the flaps or planar surfaces 1 and 2.

Figure 3F:
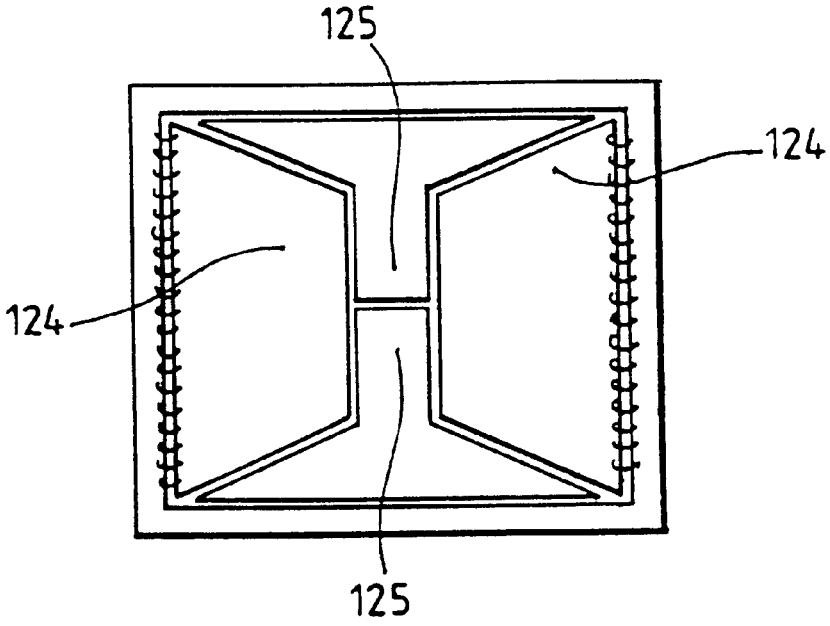
Figure 5A:
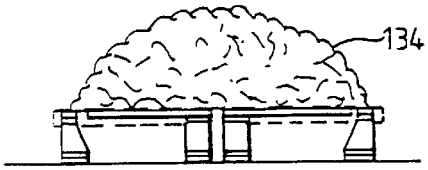
FIGS. 5A to 5D illustrate the basic concept handling a loose mass of material.
Figure 5B:
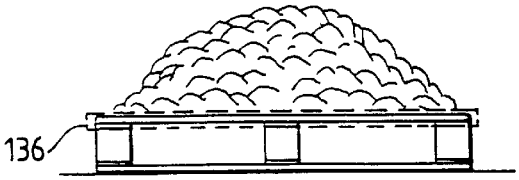
Figure 5C:
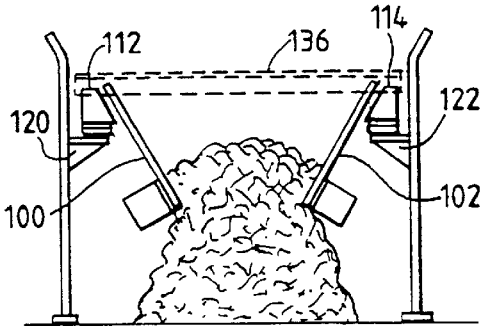
Figure 5D:
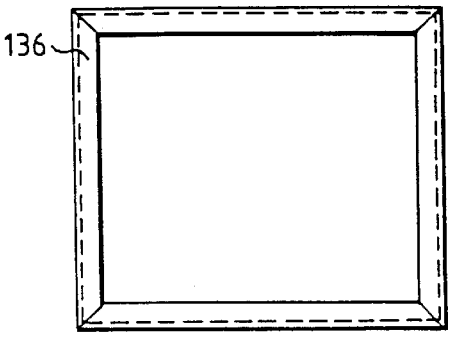

In a refinement of FIGS. 3A to 3D, FIG. 3E shows a rectangular lower sheet of, say, 12 millimeter thick plywood with lower flaps 100 and 102; and FIG. 3F shows a rectangular top sheet of, say, 6 millimeter thick plywood with upper flaps 124 and infill profile sections 125 for maintaining a flat surface when said flaps are closed. The edges of the lower and top sheets are fixed together to form the frame, and the lower sheet carries the supports 104, 106, 116 and 118 as described above. This arrangement has the advantages that there are two decks for supporting the weight and drop of the contents in filling, storing and handling; the lower deck,carrying the supports and forming the fork bearing surfaces, does not touch the contents; the top deck, in touch with the contents, can be of a different material to the lower deck or differently coated; the top deck can have flaps of any profile to suit the contents and still provide a flat surface; the two decks provide increased strength to resist "lozenging" if the pallet base is dropped or shunted at the corners; and the arrangement provides a very efficient shipping cube for dropping its contents at or near their points of first use.

These arrangements are preferred for dropping carried goods or materials which require a high degree of control of direction and rates of discharge, the sheet material of four opposing base flaps being needed to create the funnel configuration, in which cases the profiling can be designed so as to accommodate such needs.

Between the provision of a top sheet or sheets to maintain the assembly integrity and form a discharge chute, and also the capability of the swinging planar surfaces 100 and 102 to further contribute to the chute formation, a wide variety of designs and materials may be selected for any particular version of this stand alone device. Further, the pallet base of FIG. 3 may form the bases of a range of differing materials handling and packaging products which can respond to the needs of many and varied goods and materials carriage, storage and accessing applications.

For example, FIG. 4 is shown as a variant of the invention in a stand alone mode which invokes the use of upstanding sides to form a tray 132, affixed to the land surfaces 112 and 114 to secure the assembly at two of its perimeter edges, whilst the other two of its perimeter edges overlie the matching edges of the planar surfaces 100 and 102, as in 4A and 4B.

With this upstand, plan view 4D, in conjunction with the planar surfaces 100 and 102, a tray is formed as a superstructure upon the deck-spaced pallet base, and that when the assembly is caused to articulate into its discharging orientation, the upstand component remains in its affixed integral place and state. It will be seen that such a construction could be an augmentation of FIG. 3 to potential advantage.

FIG. 5 shows how a simple form of stand alone design may accomplish the handling of a loose mass of goods or materials 134. The articulation of the planar surfaces 100 and 102 is not shown, but can be effected by any plain or composite hinge or flap which joins the two work-edges of the invention's components. In this case, the integrity of the device is achieved by means of a peripheral frame 136 of angle profile of any material, which is affixed to the land surfaces 112 and 114 of the previous Figures.

This frame is shown in plan view in 5D and as a dotted component in 5A and 5B and also, in 5C, in its static, integrity-securing mode during or after completion of the egressing of the loose, previously carried, load.

Such a device might find a use on construction sites or in certain "work in progress", or in respect of the cooling down, setting, or curing of materials under processing, probably utilising a split, flexible, stripping top sheet for slip.

Figure 6A:
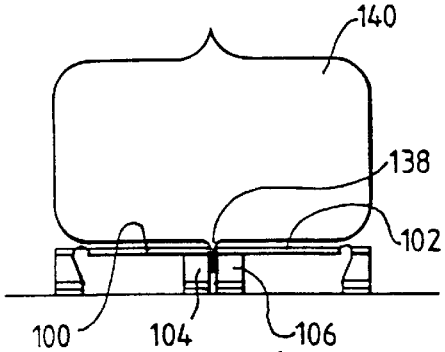
FIGS. 6A to 6C illustrate the basic concept handling material in a bag having a discharge sock.
Figure 6B:
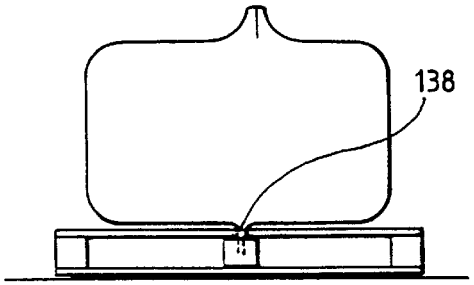
Figure 6C:
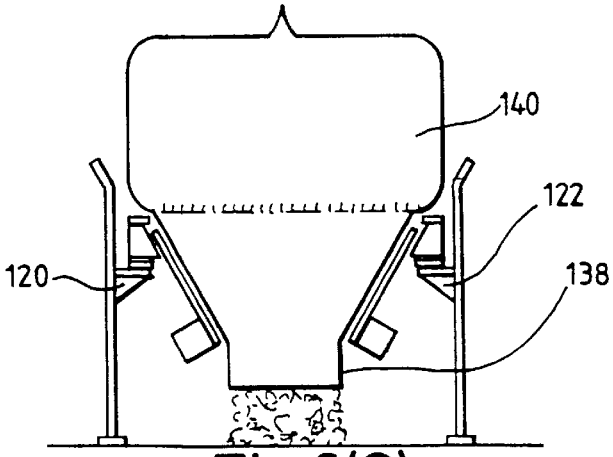
Figure 7A:
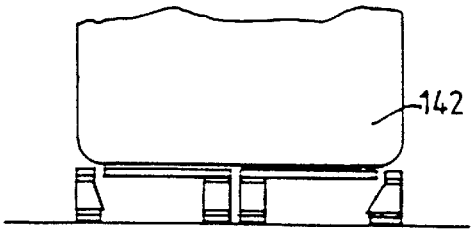
FIGS. 7A to 7D illustrate the basic concept supporting a rigid box with two complementary pairs of downwardly-openable flaps in its base.
Figure 7B:
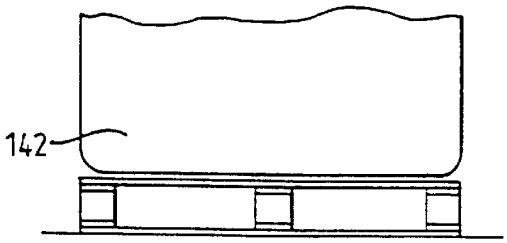
Figure 7C:
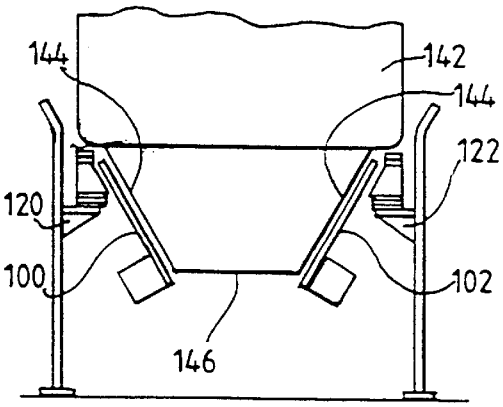
Figure 7D:
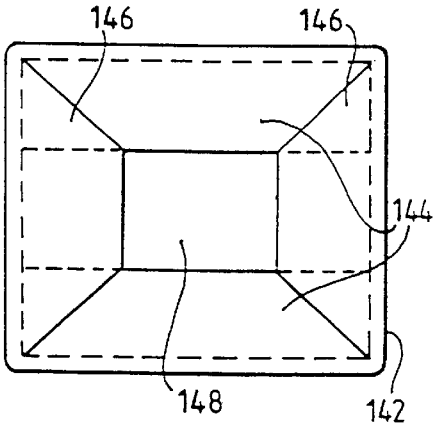

FIG. 6 shows how the invention can be used to base handle devices known as big bags. These are often lifted by top loops in order to discharge their carried contents. This can be an unstable practise due to the pendulum action occurring during travel and hoisting and cannot take place in locations where there are headroom restrictions because of the height above the loops of the lift truck mast and fork carriage.

Using the invention as the base handling means for such bags can not only overcome the stability and headroom constraints, it can be seen that if the discharge sock 138 of the bag 140, instead of being tied as is normal, is folded and pinched between the planar surfaces 100 and 102, it will be closed tightly whilst it remains attached to the invention in its deck-spaced pallet mode. If this procedure is employed, when the big bag is filled through its inlet sock 141 and handled in this way until requiring emptying, and the planar surfaces 100 and 102 are then caused to articulate, the base of the bag will drop and not only cause a break up action upon the material in the bag, the pinched sock will also drop and as it is no longer sealed by the pinching action, the material will flow out of the bags so eliminating the erstwhile untying or cutting operation.

This benign method of handling big bags will probably eliminate certain attrition and bursting forces present in top loop handling, with the opportunity to change bags' specification and improve their multiple re-use life to overall cost advantage. Further, the facility to pinch and fold each re-usable bag on its base handling articulated pallet when empty, for return for re-filling, could render such return practises more efficient than present systems.

In a modification of the embodiment of FIG. 6, the bag 140 constitutes a flexible liner within a box mounted on a pallet base, the discharge sock 138 being closed by pinching it as hereinbefore described and the inlet sock 141 being closed by pinching it in a lid for said box. Thus the contents of the bag 140 can be transported and stored hygienically, which is highly desirable in the case of items for use in the food industry such as tops for bottles.

FIG. 7 illustrates the use of the invention as the base handling device for an inter-bulk box of any design derived from the aforementioned intellectual property, or which may be conceived to take advantage of the new and novel articulating concept in materials handling and packaging systems design.

When box 142 is put upon its base into its articulating position, the outer flaps 144 and the complementary profile inner flaps 146 in its base will drop in sympathy with the planar surfaces 100 and 102 of the pallet base to form the chute effect as in 7C and 7D which are respectively side and plan views of the box and pallet base unit in the dropped state.

The shape and size of the egress hole 148, together with the angles of inclination of the flaps forming the discharge chute, are functions of both the profiles of the flaps and the degree to which they are allowed to drop open.

In many of the drawings used to exemplify the invention, it can be seen that the planar surfaces 100 and 102, when swung down, will bear against inclined inner faces 150 and 152 of supports 116 and 118 which limit the angle of opening of said surfaces as shown in FIG. 2. This facility is an option and with its use it is proposed that additional means of stopping the fall of the articulated components will be provided in order to share or remove the strain upon the hinge system caused by the weights involved in the discharging operation.

Figure 11:
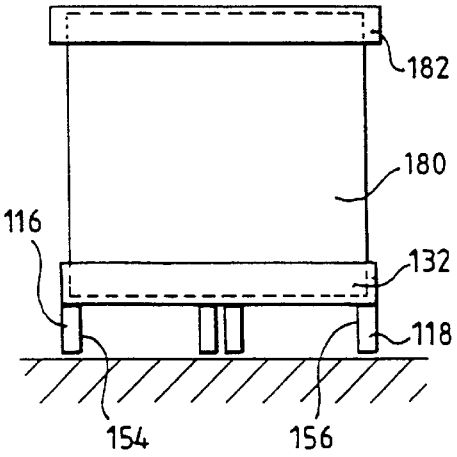
FIGS. 11 to 13 illustrate the preferred concept supporting a foldable box having a lid.

It becomes possible to drop the base of any unit using the invention to a completely open state when the supports 116 and 118 are formed with vertical inner faces 154 and 156 as for example in FIG. 11 and the planar surfaces 100 and 102 are hinged to enable them to fall to the vertical if so required when the unit is put into its articulated state. With this design, the angles of the dropped flaps may be stopped at any degree of inclination, up to the vertical, to suit the angle of repose of the material being discharged.

FIG. 8 shows a version of the invention which uses pallet collars to form the containment superstructure. Pallet collars are known per se and are devices which are normally hinged lengths of timber or plastics of the same height and thickness which may be fitted to the periphery of a pallet to form an initial upstand and then, in a modular manner, fitted one to another vertically to form a stack or box section of a height determined by the number of collars used.

Figure 8A:
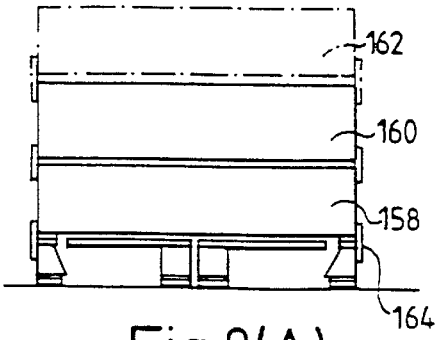
FIGS. 8A to 8D illustrate the basic concept supporting a vertical stack of pallet collars.
Figure 8B:
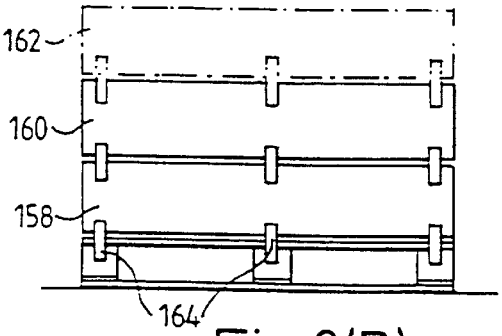
Figure 8C:
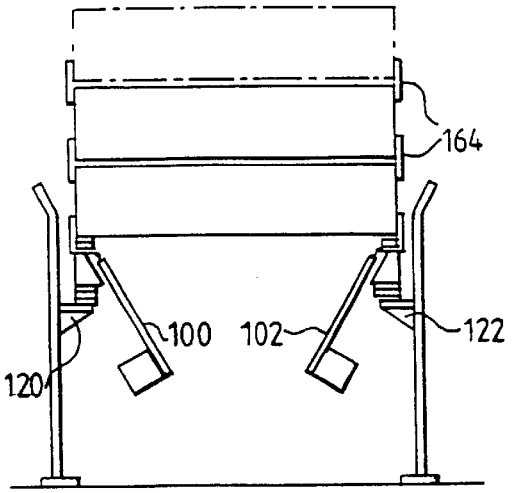
Figure 8D:
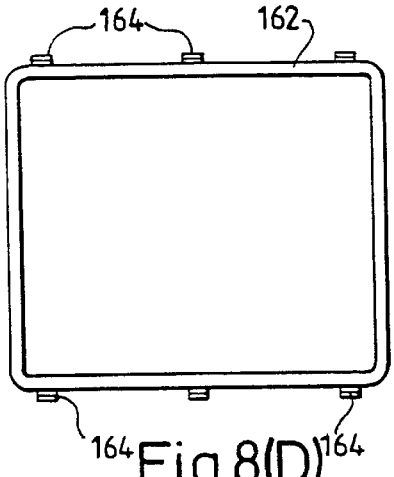

Such collars, 158, 160 and 162 may be built up on the invention in FIGS. 8A and 8B, with the locating means shown as 164 and their integrity remaining intact during the discharge of their contents shown in 8C. A plan view of the opened collar 162 ready for assembly to a unit is shown in 8D, the hinge means to fold it flat not being shown.

The versatility of instant options regarding overall height, the strength of collar construction and the collapsibility of collars when not in use, when added to the handling advantages of the present invention, can produce a very attractive unit which could feature in in-house, work-in-progress handling operations, and as an option in a returnable materials handling package range.

Figure 9:
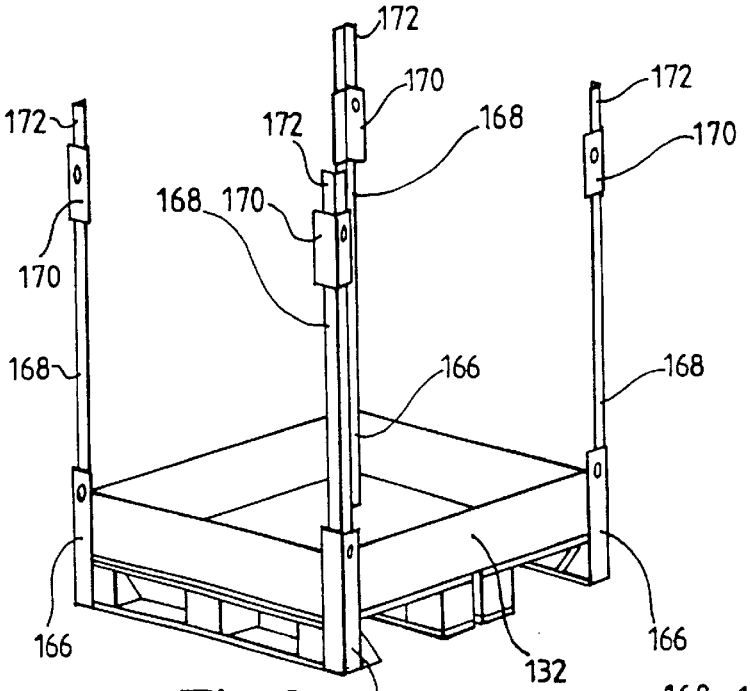
FIGS. 9 and 10 illustrate the basic concept with a tray supporting extensible corner posts.

Such a pallet collar adaptation of the invention could be used to transport, store and empty liquids, syrups or pastes, as well as powders and discrete materials, as can the following final example of the use of the invention, see FIG. 9.

FIG. 9 shows how the invention may be used in conjunction with a pallet converter to form a materials handling package option. Pallet converters are known means for creating storage and handling units by the addition of superstructures to standard pallets. There are many options of design and materials of construction available and the units formed can be such as pallet-based racks, bins, cages, etc.

When such conversions are used to contain dry goods, means such as gates, removable panels; suction, manual handling, or tipping the unit, are used to access the carried contents and loads. The successive lower and lift operations which effect the discharge action of the present invention could significantly improve the overall effectiveness of such conversions when the invention is used in place of a standard pallet.

The illustration of the invention as the base for a pallet converter is shown on a square footprint, which is usual for big bag or liner-held loose particulates or powders handling, and features a tray upstand as the integrity securing means to-enable the device to be handled as with normal palletisation, put into its articulated state for discharging of its carried contents and re-formed into its original state after the emptying operation has been completed.

The tray 132 is secured to the periphery of a pallet base, while at each corner angle components 166 are fitted so as to augment mating of the tray with the pallet base. To the components 166 are fitted vertical posts comprising lengths of suitable angle profiles capable of being folded and secured parallel to the pallet base. These lengths 168 are in turn articulated to ferules 170, which then carry extension pieces 172 with the same foldable and securable capability.

The four corner guides and supports thus formed can be the means by which sections of side walls may be assembled to create an enclosed superstructure for the containment of a variety of goods or materials, (not shown), the choice of the overall height from the top of the tray to the tops of sections 172 being dependant upon the manually handleable weights per vertical run of the selected side-plating medium.

This erected unit could house a liner to contain and protect its contents and also the whole unit would be stiffened or "tied in" with either a lid or top stays (not shown).

Figure 10:
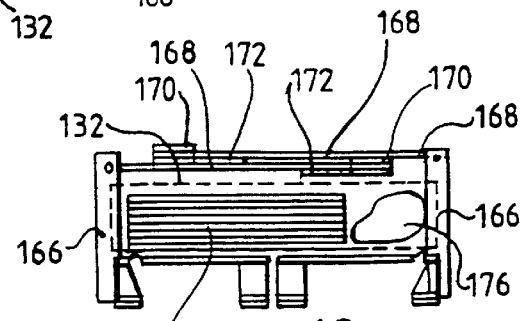

Such a double-jointed arrangement has been chosen to exemplify this version of the invention, to demonstrate how a superstructure height which is longer than any footprint dimension of the pallet base may still be cause to fold within the unit for efficient returnability. This is shown in FIG. 10, wherein the pallet base is in its deck space pallet mode, with the tray 132 in place together with the sections 166 to create a strongly integrated pallet tray into which the removed side panels 174 are seen to be stacked. This example assumes that a flexible liner has been used to contain the emptied product and this is shown as item 176 which is folded to the side of the panels 174. This facility is of importance in returnable packaging practice as, if the liner is re-usable, it is kept together with the other unit components, or even if it is disposable, it can thus be returned safely so that the product filling location can fulfil its disposal obligations.

The sections 172 of the double-jointed corner assemblies are seen to have been folded at the ferules 170, and the lengths 168 of angle profile folded about the angle components 166 so that the folded corner assemblies lie over the packed panels 174 and liner 176.

If there had been a lid included in this particular embodiment, the lid would be added to the collapsed unit to complete its preparation for its return journey. If no lid is included, then the collapsed unit may be shipped in the state illustrated, or some form of hood device maybe provided.

There are numerous option of superstructures in combination with the pallet base of the present invention, and it is perceived that the facility to drop the planar surfaces away from carried loads will find new and unique applications as it comes into widespread use the—creating of a sump section of a liquids package, for example.

Thus FIG. 11 shows how the pallet base of the present invention can be utilised to advantage in the well established cap, sleeve and tray design of a pallet pack. Such a pack is used to contain goods which are emptied by tipping or vacuum tube, then the sleeve is folded within the tray, and finally the cap is added to form a good space utilisation unit for storing or for transporting to re-fill with goods.

Figure 12:
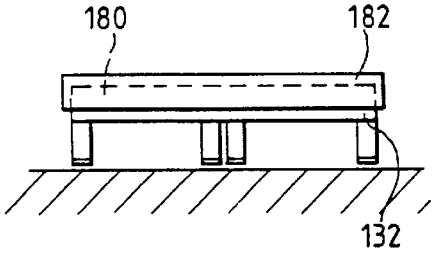

The tray 132 of FIG. 11 is in the form of that version of the pallet base of the invention with an integral peripheral upstand. FIG. 12 shows how this unit can be collapsed sleeve 180 lying within pallet tray 132 and capped with component 182.

Figure 13:
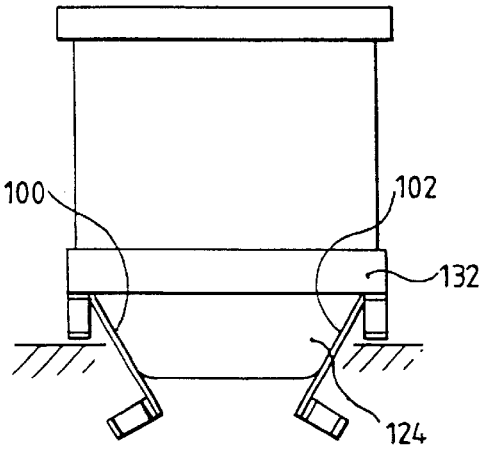

The pallet deck spacing design has also been changed compared to that of the foregoing drawings in that the outer supports are rectangular in section as opposed to the inclined design previously featured. The criterion to be addressed in the provision of these outer supports is that they must provide the necessary load bearing capability but still allow the base to drop, leaving the minimum ledge at the base of the sleeve so as not to impede the drop of the contents when the unit is put into its discharging mode shown as FIG. 13.

This deck-spaced pallet design could well feature as the base for a variety of packs and that when specified in hard materials such as timber, plastics or steel could find a use as a "standard" base for bespoke packs, possibly as a Company Group, or commercial "Pallet Pool" option.

It has been suggested earlier in this specification that the inventive concept being addressed here will inevitably lead to the development of hitherto non-existent materials handling devices possessing new and advantageous capabilities.

There follows to complete this specification three examples of such developments.

The first such device is shown in FIGS. 14 to 20 and was conceived to solve the problem of containing inter-bulk masses of "delicate" components while keeping them free from deformation and damage due to their own weight.

The requirement leading to the conception of this embodiment of the invention is the wish to deliver thin-walled caps and valve/stem assemblies to aerosol filling lines. Because of the crush forces if these articles are loose-packed into desirable masses of some 1.2 cubic meters, they are packed into smaller cartons and introduced manually to their filling line hoppers, the cartons them being disposed of or put into reclamation systems.

The arrangement about to be described can hold 1.2 cubic meters of these products, but in a supported and separated state within, in this case, six cells to keep them scuff free, and in successive lift and lower operations of a lift truck will discharge the whole mass to line hoppers, the pack then being folded into a collapsible state for return to the components supplier for re-filling and re-delivery.

Figure 14:
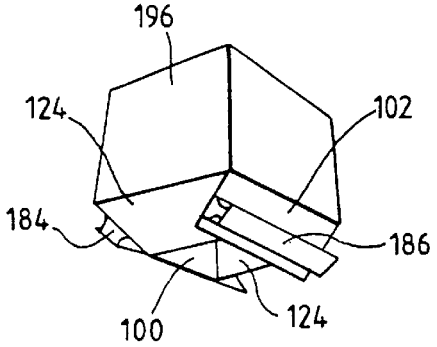
FIGS. 14 to 20 illustrate the preferred concept supporting a box which is sub-divided in order to carry delicate items in bulk without damage.

FIG. 14 is a derivative of my earlier handling sleeve invention mentioned in the preamble hereof, shows a pair of such sleeves 184 and 186 attached to outer base flaps 100 and 102 of a box case, with inner base flaps 124 profiled to form a funnel-shaped discharge chute.

To achieve the support and separation of delicate components, the fact that when the box unit is put to rest at the outside edges of the outer base flaps and the support lift truck forks are removed the base drops to its open orientation, is the basis for adaptation. A further stage of adaptation is the substitution of an articulated deck-spaced pallet base according to the present invention for the base handling sleeves shown.

Figure 15:
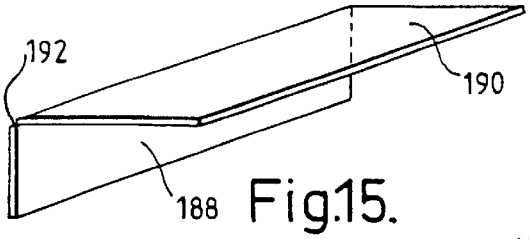

FIG. 15 is a particular design of a modular contents support and separating component or horizontal dividing flap. In this component, two planar faces 188 and 190 are hinged together about edges 192 so that face 190 will swing down to bear against 188 when this face is constrained in the vertical by being secured on the box casing.

Figure 16:
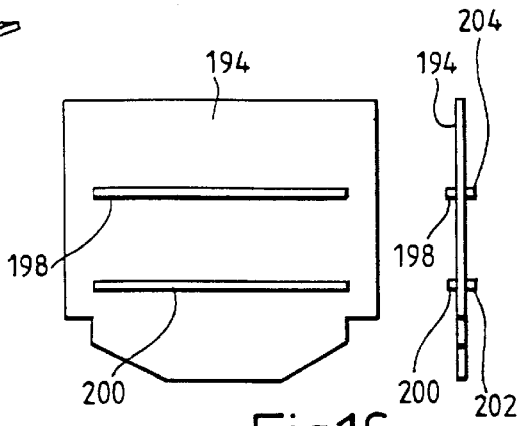

FIG. 16 is a stiff, planar wall component 194 which is designed to lie centrally within the box casing shown, centrally and parallel to face 196, to divide the box's length in two. This dividing component is loosely slideable in vertical guides on the box casing. Means are secured on this component to provide supports for the modular hinged components of FIG. 15 at the free edges of their swinging faces 190, in the form of bearers or protrusions 198, 200, 202 and 204. Further, the outline of the lower edge of this component can be seen to be profiled to enable it to perform its designed function.

Figure 17:
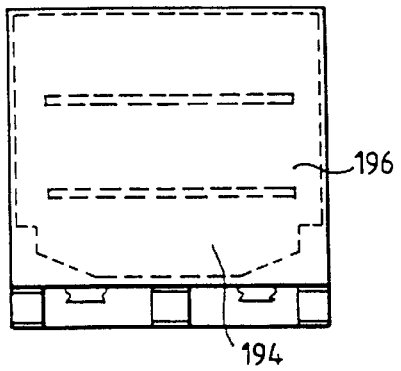

FIG. 17 shows the box of FIG. 14 looking at its face 196 mounted on a pallet base according to the present invention with the central dividing component 194 in its guide constrained orientation.

Figure 18:
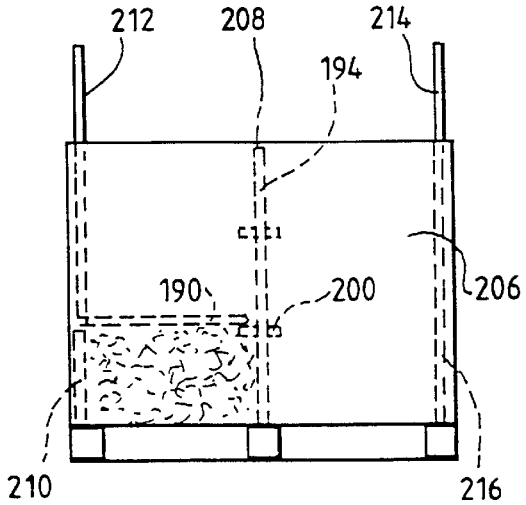

FIG. 18 shows the unit looking at its face 206 with all the requisite components except for a lid in place, the central dividing wall 194 being located with its top edge at the same height as the box sides, at point 208.

Modular supports from FIG. 15 have been added as 210, 212, 214 and 216. One cell of the box casing is shown as already filled with its separated quantity of the eventual total mass that the pack will hold, with the face 190 of the support 210 swung down to cover the packed mass module and so form a containment cell, said face being supported from dropping via its hinge by the bearer 200 on the central dividing wall 194.

Figure 19:
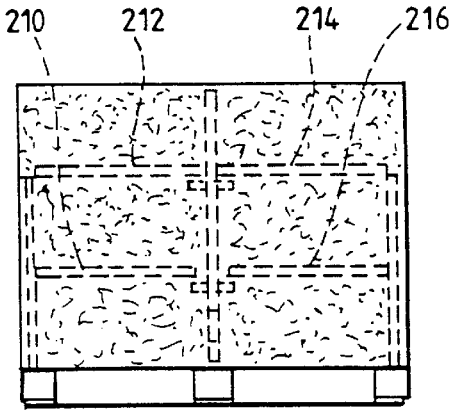
Figure 20:
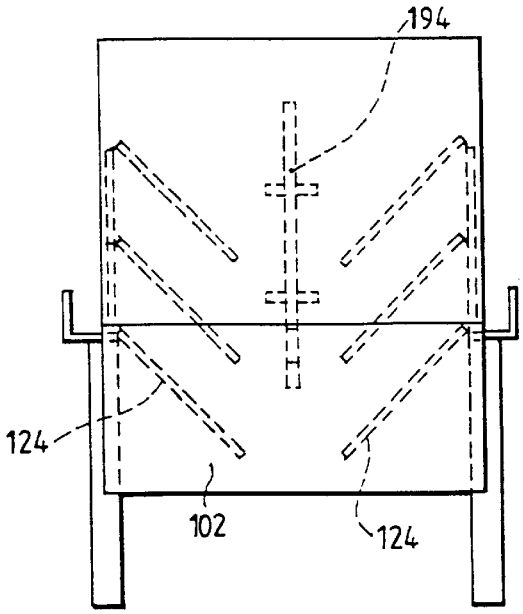

FIG. 19 indicates how the sequence of cell filling from the previous paragraph can be repeated to end up with the fulfilment of the support and separation purpose for which the pack was conceived, that is to say the sub-dividing of the pack.

Given that there now is a pack holding its cells of contents free from deformation or damage for the duration of its henceforth time in storage and transportation, the principle of the egressing of the contents to filling line hoppers is simply that the filled pack is raised by a lift truck, or otherwise conveyed to its designated dropping point and cause to become supported only at its outside flap edges. When this has been done, the base flaps will drop to any selected angle required to suit the nature of the contents' flowability, and will be accompanied downwards by the box base inner flaps and also the sliding central dividing wall 194, so that the base flaps and the wall 194 reach a new and stopped orientation.

The dropping of the central dividing wall 194 will rob the contents supporting planar faces 190 of the means to remain horizontal, and they will hinge downwards to slide their associated cell masses through the egress hole created by the profile of the dropped box base flaps.

Such a pack, whether conveyed or lift truck handled, can have its base flaps and central dividing wall 194 re-oriented for removal from the drop location and the complete pack made ready for its next use, storage, or return for re-filling.

Figure 21:
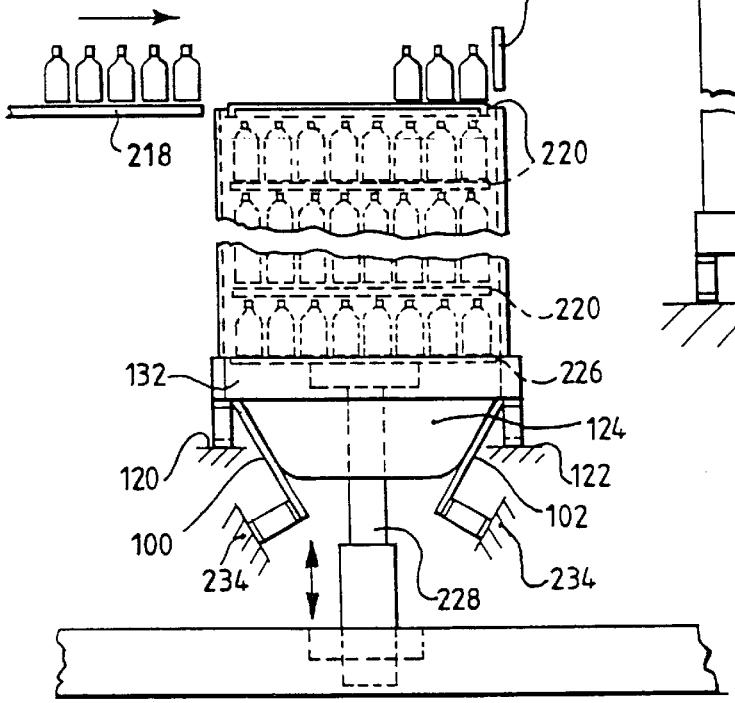
FIGS. 21 to 24 illustrate a method of loading or unloading successive tiers of items into or from a box supported by the preferred concept.

Fortuitously, this pack concept, with the integral articulated deck-spaced pallet base according to the present invention, would be compatible with existing and expensively procured tipping systems for fixed pallet boxes and tubs, the supporting and separating components being caused to hinge downwards toward the inverted pack top, possibly hinged at the central Divider and resting on bearers on the box case side walls so as to fall into a "Christmas tree" orientation on dropping the pack contents. The second development of the present invention which creates a new packaging facility is shown in FIG. 21 in which the pallet tray from FIG. 11 features as the base device for the filling, storing, carriage and egressing of tiered goods such as bottles, "bodies", cans, etc.

In this Figure, bottles are passed along a belt 218, over a rigid sheet or layer pad 220 to be marshalled against a stop 222, in a layer formation to suit the profile of the goods-containing case 224. On the completion of a layer, a pressure pad 226 supporting the layer pad 220 is caused to drop a distance equivalent to the height of the bottles, another layer pad 220 is placed on the dropped bottles, and the sequence is repeated until the required number of layers have been packed.

The pressure pad 226 is actuated by a ram 228 and it is purely because the pack base 132 has the capability to open downwardly and create access into the case 224 for the pressure pad 226 and the ram 228 that this method of packaging can be employed.

It would be possible to reverse the procedure to raise the contents layer by layer and strip the bottles, cans etc., or possibly loose-packed material goods, onto belt or chute for passage to a hopper or filling line registration means.

Figure 22:
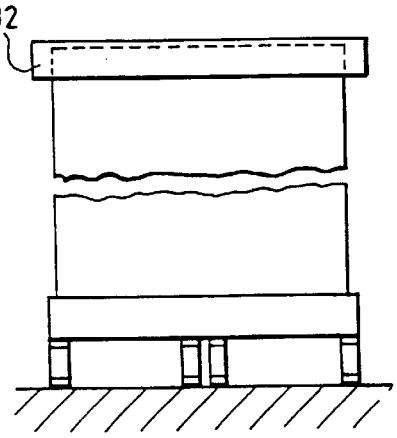
Figure 23:
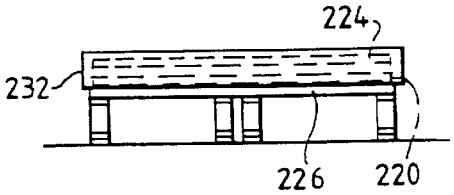
Figure 24:
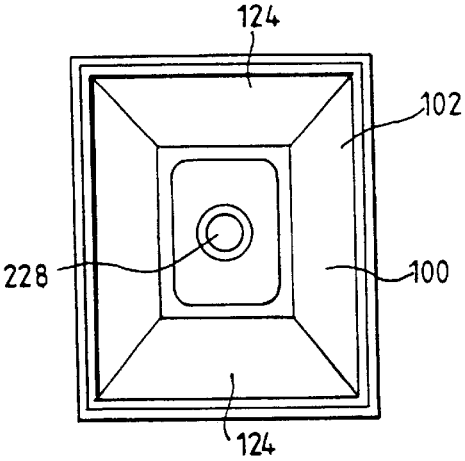

FIG. 22 shows the pack in its erected and filled state with a cap 232, whilst FIG. 23 shows it in its collapsed node, the angle of opening of the lower flaps 100 and 102 being limited by separate stop means 234. FIG. 24 is the plan view of an empty unit, showing how base flaps 100, 102 and 124 would drop to fore the access for the ram 228 which actuates the pressure pad 226.

In FIGS. 25 to 29 an articulated deck-spaced pallet base tray is once again used to create a hitherto non-existent inter-bulk package for handling material goods, which can achieve a more efficient operation, more economical transportation and more effective conservation than pallet packs already in the public domain.

Such packs for discrete materials predominantly, fall into two categories. One is a pallet box in which the containment casing for the carried goods is of rectangular or square section, matching the footprint of the separate or integral base handling pallet upon which it rests. The second pack in this category is the so-called Octobin, which is a box or sleeve of octagonal section in plan view with an octagonal cap at each end and which is integral with or rests upon a square or rectangular pallet.

The purpose of the octagonal sleeve is to provide increased resistance case bulging from the hoop strain of the contents' weight, by moving towards a rounded shape without going all the way to the best shape, that of a circle.

In so doing, the Octobin pack loses out over the pallet box in shipping space utilisation per volume of goods carried, but constrains and stacks better.

Figure 25:
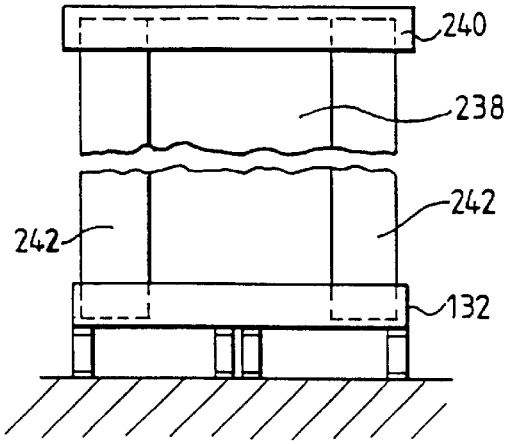
FIGS. 25 to 29 illustrate the preferred concept supporting a box which is octagonal in plan view and is strengthened by four corner fillets.

Referring to FIG. 25. this pack comprises the articulated deck-spaced pallet tray 132 of the present invention, an octagonal sleeve 238, and a cap 240 which matches the footprint of the tray. These components are shown in their collapsed mode for return or storage in FIG. 27.

It will be appreciate that when an octagonal sleeve 238 is placed upon a rectangular or square pallet base, the four angled corners faces will lie inboard of the pallet profile and expose four triangular pallet surface spaces. The same a will apply to this embodiment of the invention, in which these spaces will lie within the side walls of the tray and the cap.

This last development utilises four triangular corner fillets 242 of the same height as the octagonal sleeve whereby restraint is provided along the full height of the corner faces with the additional advantage of increasing the compression face and bringing it out to match the pallet footprint.

Figure 26:
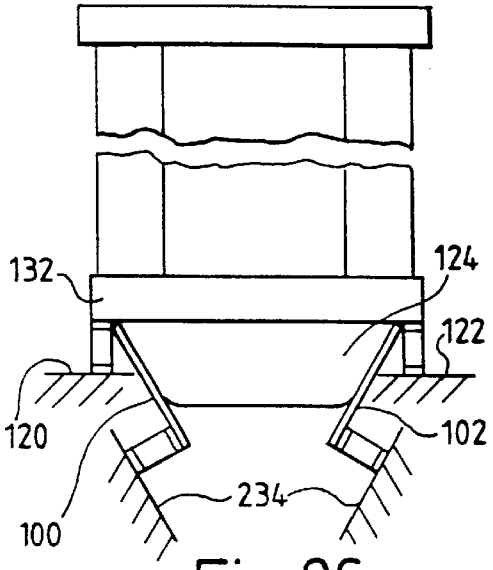
Figure 27:
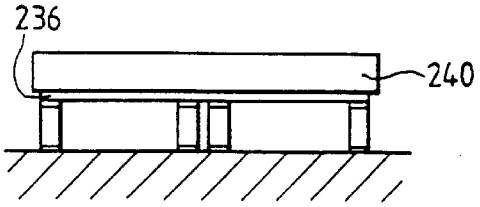
Figure 28:
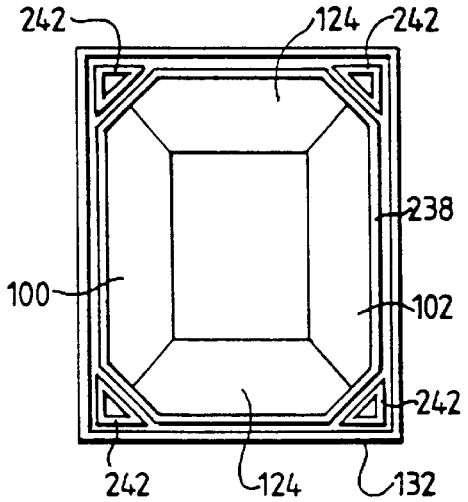

This effect can be seen in FIG. 28 which is a plan view of FIG. 26, which in turn shows the pack in its contents dropping orientation.

Figure 29:
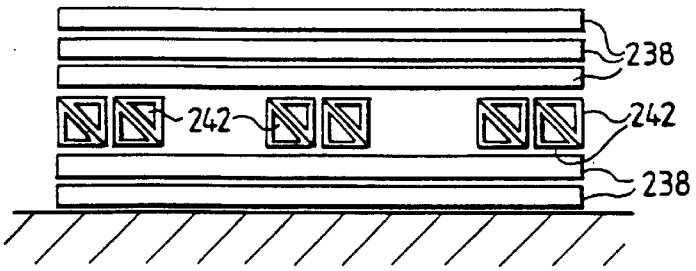

FIG. 29 shows how the fillets 242 may be used to unitise folded sleeves which are too high to accompany the pallet base and cap units, and so enable the to be handled without the need for a separate pallet in storage and return operations.

This pack has the potential to beat both pallet boxes and Octobins in criteria comparison such as:—contents capacity per shipping cube; efficiency of emptying action; contents restraint; stacking strength and multi-trip efficiency mode.

Figure 30:
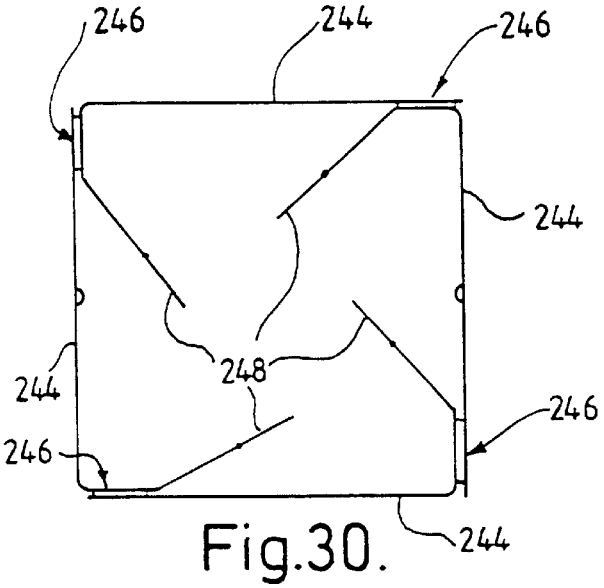
FIGS. 30 to 32 are plan views of a collapsible sleeve with hollow integral corner stiffeners.
Figure 31:
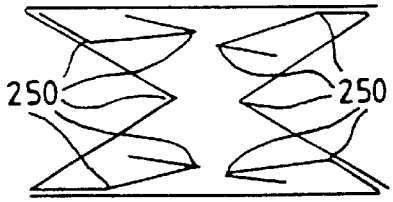
Figure 32:
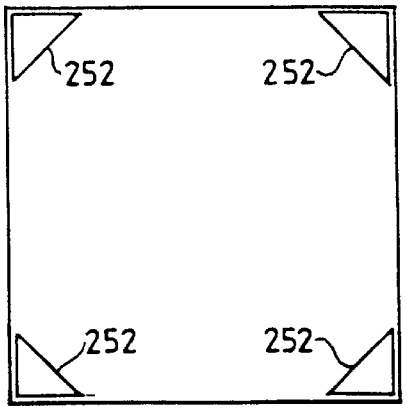

The last development of the present invention is illustrated by FIGS. 30 to 32 in which a tray (not shown) with a square footprint supports a sleeve formed from four sheets 244 glued together at 246 and having internally extending flaps 248 as shown in FIG. 30. Two opposed sheets 244 and all of the flaps 248 are scored at 250 so that the sleeve is collapsible (being shown partially collapsed in FIG. 31) into a flat state for storage and transport when empty, and so that when erected as shown in FIG. 32 the flaps 248 are foldable to form integral corner stiffeners 252 somewhat similar in principle to an Octobin which are hollow and open-ended and thus fillable with discrete material for maximum capacity.

This invention in all of its embodiments has inter alia the advantage that as emptying requires no manual intervention at the pack, it is easy to provide a fully automated discharge system employing drop tables, conveyors or the like. Further important advantages are that after every discharge operation the pallet base can be returned without manual intervention to load-carrying condition with its flaps closed; and that it can if desired be used like a conventional solid pallet without utilising its bottom-discharge facility.

What is claimed is:

1. A method of mechanically handling flowable material comprising loading it onto a deck-spaced pallet base having a frame within which there are provided a pair of downwardly-openable flaps pivotally mounted on opposed side elements of the frame, outer ground-engaging rigid supports being fixed beneath said frame elements and inner ground-engaging supports being fixed beneath the ends of the flaps remote from their pivots, whereby the flaps are held closed during loading by contact between the ground and the supports on said flaps, transporting the loaded base to a required location by applying a lifting force beneath the flaps which acts to hold them closed during transport, resting the supports on the frame elements upon suitably spaced-apart members at said location, and removing said force to permit the flaps to open without any manual intervention for central gravity discharge of the material.

2. A method according to claim 1, further comprising applying the force by means of the forks of a fork-lift truck inserted between the outer and inner supports.

3. A method according to claim 1, further comprising containing the material in a bag having a discharge sock, and keeping the sock closed by employing said flaps to pinch it until they are permitted to open.

4. A method according to claim 1, further comprising containing the material in a flexible liner within a box mounted on the pallet base, the liner having a discharge sock closed by employing said flaps to pinch it until they are permitted to open, and an inlet sock closed by pinching it in a lid for said box.

5. A method according to claim 1, further comprising loading or unloading a box mounted on the pallet base by resting the supports on the frame elements upon suitably spaced-apart members, so that the flaps are permitted to open, inserting a ram upwards through the opening, and activating the ram in stages so as to lower into or raise out of the box successive layers of items such as bottles supported on rigid sheets which fit closely within the box.

6. Apparatus for mechanically handling flowable material comprising a deck-spaced pallet base having a frame within which there are provided a pair of downwardly-openable flaps pivotally mounted on opposed side elements of the frame, outer ground-engaging rigid supports being fixed beneath said frame elements and inner ground-engaging supports being fixed beneath the ends of the flaps remote from their pivots.

7. Apparatus according to claim 6, wherein the inner and outer supports are so spaced apart as to allow entry of the forks of a fork-lift truck from any side of the pallet base.

8. Apparatus according to claim 6, wherein the adjacent faces of the outer supports are inclined in order to limit the angle of opening of the flaps.

9. Apparatus according to claim 8, wherein another pair of downwardly-openable flaps are pivotally mounted above the first-mentioned pair thereof on the other two sides of the frame, said other pair of flaps being so shaped that their angle of opening is limited by the open position of the first-mentioned pair of flaps.

10. Apparatus according to claim 9, wherein the frame comprises the edges of a lower sheet incorporating the first-mentioned pair of flaps and the edges of a top sheet incorporating said other pair of flaps, the edges of the two sheets being fixed together.

11. Apparatus according to claim 9, wherein the frame comprises the edges of a top sheet incorporating said other pair of flaps, the elements on which the first-mentioned pair of flaps are pivotally mounted being separately secured beneath opposing edges of the top sheet.

12. Apparatus according to claim 6, wherein the pallet base supports a rigid box having two complementary pairs of downwardly-openable flaps in its base.

13. Apparatus according to claim 6, wherein the frame comprises, or has fixed to it, upstanding sides which form a tray.

14. Apparatus according to claim 13, wherein the corners of the tray support vertical posts which are capable of being extended, of locating a liner and/or side panels, of being folded parallel to the pallet base, and/or of having a lid or top stays.

15. Apparatus according to claim 13, wherein a foldable sleeve with open top and bottom fits within the sides of the tray both when erected and when collapsed.

16. Apparatus according to claim 15, wherein a cap fits over the sleeve when the sleeve is both erected and collapsed.

17. Apparatus according to claim 13, wherein the tray supports a box which is octagonal in plan view for improved strength, a square or rectangular lid of the same shape and dimensions in plan view as the tray is provided for the box, and four fillets of triangular cross-section fit between the corners of the tray and the corners of the lid along the angled sides of the box to strengthen the box further.

18. Apparatus according to claim 13, wherein the tray supports a collapsible sleeve which has internal flaps foldable to form hollow integral corner stiffeners.

19. Apparatus according to claim 6, wherein the pallet base supports a pallet collar or a vertical stack of a plurality of pallet collars.

20. Apparatus according to claim 6, wherein the pallet base supports a box which is sub-divided in order to carry delicate items in bulk without damage by means of a central dividing wall slideable in vertical guides on the box, and at least one pair of horizontal dividing flaps pivotally mounted at their outer ends on the box, and supported at their inner ends on bearers on the central wall, the arrangement being such that when the downwardly-openable flaps of the pallet base are permitted to open the central wall falls and permits the dividing flaps to pivot downwards for gravity discharge of the items.

* * * * *